United States Patent [19]

Stark

[11] Patent Number: 4,731,634

[45] Date of Patent: Mar. 15, 1988

[54] APPARATUS FOR PRINTING BLACK AND PLURAL HIGHLIGHT COLOR IMAGES IN A SINGLE PASS

[75] Inventor: Howard M. Stark, Webster, N.Y.

[73] Assignee: Xerox Corporation, Stamford, Conn.

[21] Appl. No.: 925,933

[22] Filed: Nov. 3, 1986

[51] Int. Cl.[4] ..... G03G 15/01

[52] U.S. Cl. ..... 355/3 TR; 355/4

[58] Field of Search ..... 355/3 R, 3 TR, 4, 14 TR

[56] References Cited

U.S. PATENT DOCUMENTS

| | | | |
|---|---|---|---|
| 2,297,691 | 10/1942 | Carlson | 95/5 |
| 2,576,047 | 10/1948 | Schaffert | 101/426 |
| 2,647,464 | 10/1949 | Ebert | 101/426 |
| 2,825,814 | 6/1954 | Walkup | 250/49.5 |
| 3,013,890 | 7/1958 | Bixby | 117/17.5 |
| 3,045,644 | 6/1957 | Schwertz | 118/637 |
| 3,816,115 | 6/1974 | Gundlace et al. | 96/1.4 |
| 3,832,170 | 4/1970 | Nagamatsu et al. | 96/1.2 |
| 3,838,919 | 10/1974 | Takahashi | 355/4 |
| 4,068,938 | 1/1978 | Robertson | 355/4 |
| 4,078,929 | 3/1978 | Gundlack | 96/1.2 |
| 4,346,982 | 8/1982 | Nakajima et al. | 355/3 R |
| 4,403,848 | 9/1983 | Snelling | 355/4 |
| 4,477,176 | 10/1984 | Russel | 355/7 X |
| 4,562,129 | 12/1985 | Tanaka et al. | 430/42 |
| 4,562,130 | 12/1985 | Oka | 430/54 |
| 4,660,961 | 4/1987 | Kuramoto et al. | 355/4 |

*Primary Examiner*—Peter S. Wong

[57] ABSTRACT

The method and apparatus for rendering latent electrostatic images visible using multiple colors of dry toner or developer and more particularly to printing toner images in black and at least two highlighting colors in a single pass of the imaging surface through the processing areas of the printing apparatus. Two of the toners are attracted to only one charge level on a charge retentive surface to thereby providing black and one highlight color while two toners are attracted to another charge level to form the second highlight color.

20 Claims, 2 Drawing Figures

APPARATUS FOR PRINTING BLACK AND PLURAL HIGHLIGHT COLOR IMAGES IN A SINGLE PASS

BACKGROUND OF THE INVENTION

This invention relates generally to the rendering of latent electrostatic images visible using multiple colors of dry toner or developer and, more particularly, to printing toner images in black and at least two highlighting colors in a single pass of the imaging surface through the processing areas of a printing apparatus.

The invention can be utilized in the art of xerography or in the printing arts. In the practice of xerography, it is the general procedure to form an electrostatic latent image on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with a toner. The toner is generally a colored powder which adheres to the charge pattern by electrostatic attraction.

The developed image is sometimes then fixed to the imaging surface or is transferred to a receiving sheet to which it is fixed.

This method of forming and developing charge patterns is set forth in greater detail in U.S. Pat. No. 2,297,691 to C. F. Carlson. Still other means of forming and developing electrostatic images are set forth in U.S. Pat. No. 2,647,464 to J. P. Ebert; U.S. Pat. No. 2,576,047 to R. M. Schaffert and U.S. Pat. No. 2,825,814 to L. E. Walkup.

Modern business and computer needs oftentimes make it advantageous and desirable to reproduce originals which contain two or more colors. It is sometimes important that the copy reproduced also contain two colors.

An accounting report having certain information highlighted in a second color is one example of a type of document which would desirably be copied in more than one color. Computer generated cathode ray tube (CRT) displays are another example in which it is sometimes desirable to reproduce an image in more than one color. For instance, it is sometimes desirable that those portions of the CRT display image representing permanent forms are reproduced in a first color and those portions of the image representing variable information are reproduced in a second color.

Several useful methods are known for making copies having plural colors. Some of these methods make high quality images, however, there is need for improvements. In particular, it is desirable to be able to print images having two or more highlight colors rather than being limited to a single highlight color. It is also desirable to be able to produce such images in a single pass of the photoreceptor or other charge retentive surface past the printing process areas or stations One method of producing images in plural (i.e. two colors, black and one highlight color) is disclosed in U.S. Pat. No. 3,013,890 To W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method of Bixby develops positively charged image areas with the negative toner and develops negatively charged image areas with the positive toner. A two-color image occurs only when the charge pattern includes both positive and negative polarities.

Plural color development of charge patterns can be created by the Tesi technique. This is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making color xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

Still another method of creating two-color images, as disclosed in U.S. Pat. No. 4,078,929, utilizes a charge pattern of only one polarity on an imaging surface. The charge pattern includes charged areas at one voltage level corresponding to background voltages and charged image areas at two other voltage levels different from the background level. One of the image voltages is greater in magnitude than the background voltage and the other is smaller in magnitude.

The charge pattern in the U.S. Pat. No. 4,078,929 is developed with toner particles of first and second color. The toner particles of one of the colors is positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

As disclosed in U.S. Pat. No. 4,403,848, a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

In U.S. Pat. No. 4,562,129 there is disclosed an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a nonmagnetic insulating toner and a high-resistivity magnetic carrier triboelectrically chargeable with the toner and having a high resistivity of at least 10<12> ohm-cm, the carrier being in the form of particles about 5 to about 40 microns in size, prepared by dispersing a magnetic fine powder in an insulating resin and containing the magnetic fine powder in a proportion of 50 to 75% by weight.

U.S. Pat. No. 4,562,130 relates to a composite image forming method having the following features: (A) Forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly, the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346,982, there is disclosed an electrophotographic recording device having means for uniformly charging the surface of a light-sensitive recording medium, means for forming latent images on said light-sensitive recording medium and means for developing said latent images into visual images, said electrophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

As can be gleaned from the foregoing discussion of the prior art and from a further investigation of the the references noted, the prior art in the area of multiple color printing of electrostatically formed images is limited to the production of such images in black plus a single highlight color. The desirability of producing black and multiple highlight color images in a single process pass can be appreciated.

BRIEF DESCRIPTION OF THE INVENTION

My invention relates to an imaging process for producing multiple color images. In particular, it relates to a printing system wherein black plus plural highlight images are produced in a single pass of a charge retentive surface past the processing areas of the printing apparatus. This single pass limitation includes the exposure area whereat a single exposure is provided for effecting the discharge of the charge retentive surface to at least four voltage levels. The present invention is directed to a highlight color process wherein more than two different highlight color images are developed in a single pass of the photoreceptor past a plurality of developer housings. As presently contemplated, in order to carry out the invention, the charge retentive surface, initially charged to a voltage $V_{black}$ (corresponding to black area development), is discharged to $V_w$ imagewise in the background (white) image areas and to $V_d$ and $V_a$, corresponding to two highlight color image areas. There are three developer housings containing black and two subtractive primary colors. For example, developer housings containing black, cyan and magenta are employed. The charge retentive surface containing the images is moved past these housings in a single pass. Color discrimination in the development of the electrostatic latent image is achieved by electrically biasing the developer housings to voltages which are offset from the background voltage $V_w$, the direction of offset depending on the toner in the housing. Thus, the toners contained in the developer housings are attracted by predetermined ones of the potentials on the charge retentive surface. One housing contains black developer having triboelectric properties so that it is driven or attracted to the $V_b$ charged areas of the latent images by the electric field established between the $V_b$ charged areas of the photoreceptor and the bias level on that developer housing. The other housings contain developer that is triboelectrically charged so it is attracted or driven to the discharged parts of the photoreceptor representing the highlight color image areas.

Prior to transfer of the two color image it is subjected to a pre-transfer corona discharge to condition the toner for effective transfer to a substrate using corona discharge.

DETAILED DESCRIPTION OF THE PREFERRED EMBODIMENTS OF THE INVENTION

For a general understanding of the features of the present invention, a description thereof will be made with references to the drawings.

Figure 1:
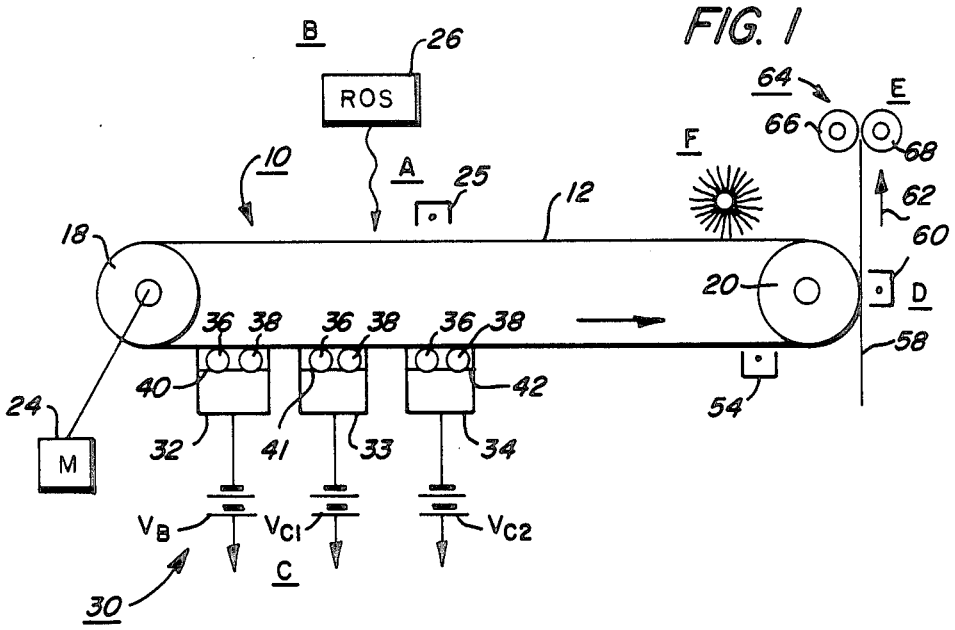
FIG. 1 is a schematic view of an electrophotographic printing machine incorporating the features of the present invention therein.
Figure 2:
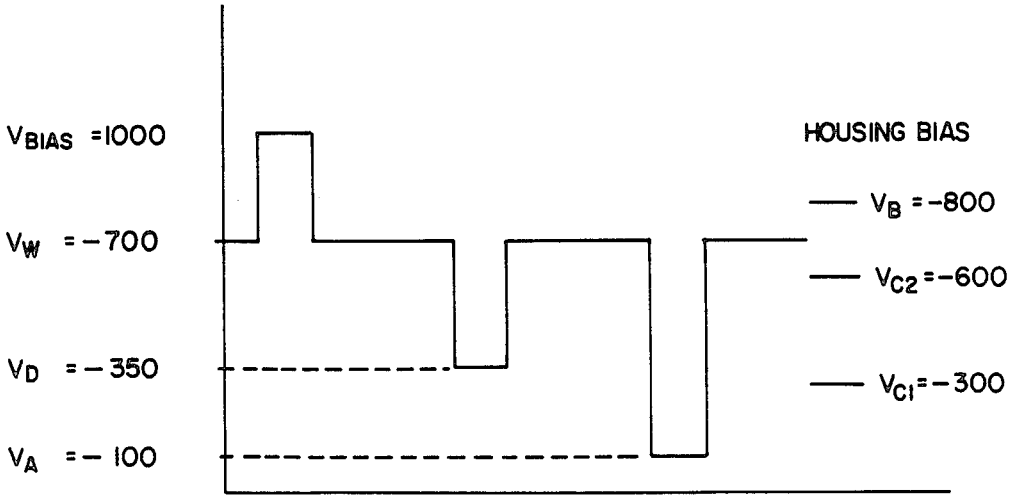
FIG. 2 is a graphic illustration representing the comparative voltage values of the various areas of a charge pattern useful in the practice of the present invention.

FIG. 1 schematically depicts the various components of an illustrative electrophotographic printing machine incorporating the present invention. In as much as the art of electrophotographic printing is well known, the various processing stations employed in the printing machine illustrated in Figure. 1 will be described only briefly.

As shown in FIG. 1, the printing machine utilizes a photoconductive belt 10 which consists of a photoconductive surface 12 and an electrically conductive substrate 14. Belt 10 moves in the direction of arrow 16 to advance successive portions thereof sequentially through the various processing stations disposed about the path of movement thereof. Belt 10 is entrained about a pair of rollers 18 and 20, the former of which can be used as a drive roller and the latter of which can be used to provide suitable tensioning of the photoreceptor belt 10. Motor 24 rotates roller 18 to advance belt 10 in the direction of arrow 16. Roller 18 is coupled to motor 24 by suitable means such as a belt drive.

As can be ssen by further reference to FIG. 1, initially a portion of belt 10 passes through charging station A. At charging station A, a corona discharge device such as a scorotron or corotron indicated generally by the reference numeral 25, charges the belt 10 to a selectively high uniform negative potential, $V_O$.

Next, the charged portion of photoconductive surface is advanced through exposure station B. At exposure station B, The uniformly charged photoreceptor or charge retentive surface 10 is exposed to a laser based input and/or output scanning device 26 which causes the charge retentive surface to be discharged in accordance with the output from the scanning device. Preferably the scanning device is a four level Raster Output Scanning device.

The photoreceptor which is initially charged to a voltage $V_{black}$ (approx. −1000 volts), is discharged to $V_w$(approx. −700 volts) imagewise in the background (white) image areas and to $V_d$(approx. −350 volts) and $V_a$ (approx. −100 volts) in the highlight (i.e. color other than black) image areas. At development station C, a magnetic brush development system, indicated generally by the reference numeral 30 advances developer materials into contact with the electrostatic latent images. The development system 30 comprises first, second and third developer housings 32, 33 and 34. Preferably, each of the magnetic brush development housings includes two magnetic brush developer rollers 36 and 38. These rollers advance their respective developer materials into contact with the latent image. Each developer roller pair forms a brush comprising toner particles which are attracted by the latent images on the photoreceptor.

By way of example, one of the three developer housings contains positively charged black toner 40 and the other two contain negatively charged magenta and cyan toners 41 and 42. The charge retentive surface containing the images is moved past these housings in a single pass. Color discrimination in the development of the electrostatic latent image is achieved by electrically biasing the three housings 32, 33 and 34 to suitable voltages for effecting the attraction of the desired toners to the different potentials on the charge retentive surface. Thus, the housings 32. 33 and 34 may be biased respectively to minus 800, 300 and 600 volts, the biasing being provided by dc voltage sources $V_b$, $V_{c1}$ and $V_{c2}$.

In the preferred embodiment of the invention as disclosed in FIG. 1, the housing 32 contains black developer having triboelectric properties (i.e. positive charge) so that it is driven or attracted to the $V_{black}$ charged areas of the latent images by the electrostatic field established between the $V_{black}$ charged areas of the photoreceptor and the voltage level of the bias $V_b$ on the developer housing. The housing 33 contains magenta developer that is triboelectrically charged (i.e. negatively) and it is biased so the magenta toner is attracted or driven to to the parts of the photoreceptor which are charged to the voltage level $V_a$. The housing 34 contains cyan toner that is triboelectrically charged (i.e. negatively) and the housing is biased so that this toner is attracted or driven to the area of the charge retentive surface charged to the voltage level $V_a$ and $V_d$. The resulting multiple color image is made up of black, magenta and blue colors.

| Developer Housing | Housing Bias | $V_{black}$ −1000 volts | $V_a$ −100 volts | $V_d$ −350 volts | $V_w$ −700 volts |
|---|---|---|---|---|---|
| 32 (black) | −800 | DEV | No Dev | No Dev | No Dev |
| 33 (Magenta) | −300 | No Dev | DEV | No Dev | No Dev |
| 34 (Cyan) | −600 | No Dev | DEV | DEV | No Dev |
| Resultant | Color | 32 | 33 & 34 | 34 | White |

From a consideration of the above table, it can be seen that the black toner is attracted to the $V_{black}$ voltage areas and repelled from the other two charged areas. This is because the $V_{black}$ areas of the photoreceptor are at a charge level of minus 1000 volts while the bias on the developer housing 33 is at minus 800 volts and the black developer is positively charged. Thus, the positively charged black developer is attracted to the photoreceptor areas which are more negative than the bias on the housing 32. Conversely, the black toner in the housing 32 will not be attracted to the photoreceptor areas that are more positive than the housing 32 bias.

The cyan toner is attracted to both of the Voltage areas $V_a$ and $V_d$. This is because these voltage levels on the photoreceptor are more positive than the biases on the two developer housings and the toner contained in them is negatively charged.

The magenta toner is attracted to the voltage areas at the level $V_a$. This is due to the voltage level $V_a$ being less negative than the bias on the developer housing 33 and the negative charge on the toner in that housing. The magenta toner is not attracted to the photoreceptor areas at the voltage level $V_d$ because these areas are more negative than the bias on the housing 33 and the magenta toner is, therefore, repelled by these areas.

Thus, the charged areas at levels $V_b$ and $V_d$ attract a single toner from either housing 32 or 33 while the voltage areas $V_a$ attract two colors (i.e. cyan and magenta) from the housings 33 and 34 resulting in the color blue. The areas of the charge retentive surface charged to the level $V_w$ are not developed by any of the toners because of the biasing of the toner housings and the polarities of the toners. It will be appreciated by those skilled in the art that other primary toner colors can be employed in various combinations and that the primary colors may be subtractive.

Prior to transfer of the two color image it is subjected to a pretransfer corona discharge to condition the toner for effective transfer to a substrate using corona discharge.

As successive electrostatic latent images are developed, toner particles are depleted from the developer material. Toner particle dispensers, not shown, are arranged to furnish additional toner particles to housings 32, 33 and 34 for subsequent use by developer rollers disposed therein.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack copy sheets. Feed rolls rotate so as to advance the uppermost sheet from stack into contact with photoconductive surface 12 of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from photoconductive surface 12 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a back-up roller 68. Sheet 58 passes between fuser roller 66 and back-up roller 68 with the toner powder image contacting fuser roller 66. In this manner, the toner powder image is permanently affixed to sheet 58. After fusing, chute, not shown, guides the advancing sheet 58 to catch tray, also not shown, for subsequent removal from the printing machine by the operator.

After the sheet of support material is separated from photoconductive surface of belt 10, the residual toner toner particles and the wrong sign/color toner particles carried by the non-image areas on the photoreceptor are removed therefrom. These particles are removed from photoconductive surface at cleaning station F.

Subsequent to cleaning, a discharge lamp (not shown) floods the photoconductive surface with light to dissipate any residual electrostatic charge remaining prior to the charging thereof for the successive imaging cycle.

What is claimed:

1. Apparatus for forming latent electrostatic images on a charge retentive surface and rendering them visible with black and at least two highlight color toners in a single pass of the imaging surface through the processing areas of a printing system, said apparatus comprising:

means for uniformly charging said charge retentive surface;

an exposure system for discharging said charge retentive surface to at least four voltage levels corresponding to image and background areas; and means including a plurality of developer structures each including a developer housing containing a different color toner for rendering at least three image areas visible, each of two of said three image areas being rendered visible by the application of only one of said different color toners to said two image areas on said charge retentive surface and one of said image areas being rendered visible by the application of two of said different color toners to one image area on said charge retentive surface.

2. Apparatus according to claim 1 wherein said means for rendering said at least three image areas visible comprises means for creating electrostatic fields between said housings and said charge retentive surface for attracting different toners to different areas of said charge retentive surface and repelling said different toners from other areas of said charge retentive surface.

3. Apparatus according to claim 2 wherein said developer housings are electrically biased to different voltage levels for rendering visible two of the image areas on the charge retentive surface with only one toner and for rendering one of said image areas visible with two toners.

4. Apparatus according to claim 3 wherein one of said toners is triboelectrically charged negatively and the other ones are charged positively.

5. Apparatus according to claim 4 wherein said exposure system comprises a raster output scanner.

6. Apparatus according to claim 5 wherein said charge retentive surface comprises a photoreceptor.

7. Apparatus according to claim 6 wherein said photoreceptor is uniformly charged with charges of a negative polarity.

8. Apparatus according to claim 1 wherein said four voltage levels are of a negative polarity and wherein the highest level is developed by black toner and the two lowest levels are developed by highlight colors while the next to the highest level corresponds to a non-developed background voltage level that isn't developed.

9. Apparatus according to claim 8 wherein said electrostatic fields result in the non-development of one of said voltage levels.

10. Method of forming latent electrostatic images on a charge retentive surface and rendering them visible with black and at least two highlight color toners in a single pass of the imaging surface through the processing areas of a printing system, said method comprising:

uniformly charging said charge retentive surface;

exposing said uniformly charged charge retentive surface to thereby discharge it to at least four voltage levels corresponding to image and background areas; and providing means including a plurality of developer structures each including a developer housing containing a different color toner for rendering at least three image areas visible, each of two of said three image areas being rendered visible by the application of only one of said different color toners to said two image areas on said charge retentive surface and one of said image areas being rendered visible by the application of two of said different color toners to one image area on said charge retentive surface.

11. The method according to claim 10 further including the step of creating electrostatic fields between said housings and said charge retentive surface for attracting different toners to different areas of said charge retentive surface and and repelling said different toners from other areas of said charge retentive surface.

12. The method according to claim 11 including biasing said developer housings to different voltage levels for for rendering visible two of the image areas on the charge retentive surface with only one toner and for rendering one of said image areas visible with two toners.

13. The method according to claim 12 wherein one of said toners is triboelectrically charged negatively and the other ones are charged positively.

14. The method according to claim 13 wherein said exposure system comprises a raster output scanner.

15. The method according to claim 14 wherein said charge retentive surface comprises a photoreceptor.

16. The method according to claim 15 wherein said photoreceptor is uniformly charged with charges of a negative polarity.

17. The method according to claim 10 wherein said four voltage levels are of a negative polarity and wherein the highest level is developed by black toner and the two lowest levels are developed by highlight colors while the next to the highest level corresponds to a non-developed background voltage level that isn't developed.

18. The method according to claim 17 wherein said electrostatic fields result in the non-development of one of said voltage levels.

19. Apparatus for forming latent electrostatic images on a charge retentive surface and rendering them visible with black and at least two highlight color toners in a single pass of the imaging surface through the processing areas of a printing system, said apparatus comprising:

means for uniformly charging said charge retentive surface;

an exposure system for discharging said charge retentive surface to at least four voltage levels corresponding to image and background areas; and means including a plurality of developer structures each including a developer housing containing a different color toner for rendering at least three image areas visible;

means for simultaneously transferring said the images in said three image areas to a copy substrate.

20. Apparatus according to claim 19 wherein said means for rendering at least three image areas visible comprises means for effecting application of only one of said different color toners to each of two of said three image areas on said charge retentive surface and the application of two of said different color toners to one image area on said charge retentive surface.

* * * * *